US009113278B2

(12) United States Patent
Allen et al.

(10) Patent No.: US 9,113,278 B2
(45) Date of Patent: Aug. 18, 2015

(54) SYSTEM AND METHOD FOR AUTOMATICALLY ADJUSTING HEARING AID BASED ON ACOUSTIC REFLECTANCE

(76) Inventors: Jont B Allen, Mahomet, IL (US); Patricia S Jeng, Mahomet, IL (US)

( * ) Notice: Subject to any disclaimer, the term of this patent is extended or adjusted under 35 U.S.C. 154(b) by 411 days.

(21) Appl. No.: 12/773,731

(22) Filed: May 4, 2010

(65) Prior Publication Data

US 2010/0215200 A1 Aug. 26, 2010

Related U.S. Application Data

(62) Division of application No. 11/061,368, filed on Feb. 18, 2005, now Pat. No. 7,715,577.

(60) Provisional application No. 60/619,517, filed on Oct. 15, 2004.

(51) Int. Cl.
*H04R 25/00* (2006.01)

(52) U.S. Cl.
CPC ..... *H04R 25/70* (2013.01)

(58) Field of Classification Search
USPC ..... 381/60, 312–321, 328; 600/559
See application file for complete search history.

(56) References Cited

U.S. PATENT DOCUMENTS

| | | | | |
|---|---|---|---|---|
| 6,115,478 | A * | 9/2000 | Schneider | 381/314 |
| 6,876,751 | B1 * | 4/2005 | Gao et al. | 381/318 |
| 7,536,022 | B2 * | 5/2009 | Von Buol | 381/318 |

* cited by examiner

*Primary Examiner* — Suhan Ni

(57) ABSTRACT

Method and system for automatically adjusting a hearing aid. The method includes measuring an acoustic reflectance associated with an ear canal as a function of an incident pressure and an acoustic frequency, processing information associated with the measured acoustic reflectance, determining a reflectance slope based on, at least, information associated with the measured acoustic reflectance, and adjusting, at least, one parameter associated with the hearing aid based on, at least, information associated with the reflectance slope. The reflectance slope is associated with a reflectance component varying with the incident pressure.

18 Claims, 9 Drawing Sheets

SYSTEM AND METHOD FOR AUTOMATICALLY ADJUSTING HEARING AID BASED ON ACOUSTIC REFLECTANCE

CROSS-REFERENCES TO RELATED APPLICATIONS

This application is a divisional of U.S. patent application Ser. No. 11/061,368, entitled "Dual Mode Communication Systems and Methods", filed Feb. 18, 2005, now U.S. Pat. No. 7,715,577 which claims priority to U.S. Provisional Application No. 60/619,517, filed Oct. 15, 2004, all which are entirely incorporated by reference herein for all purposes.

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The present invention relates generally to acoustic devices. More specifically, the invention provides a method and system for automatically adjusting acoustic devices based on acoustic reflectance. For example, the acoustic reflectance is a relationship between reflected waves and incident waves. Merely by way of example, the invention has been applied to hearing aids, but it would be recognized that the invention has a much broader range of applicability.

Hearing aids have been widely used to compensate hearing losses of human ears. A human ear is comprised of an outer ear, a middle ear, and an inner ear. The outer ear includes an ear canal, the middle ear includes an eardrum, and the inner ear includes a cochlea. Depending on individual needs, people often use different types of hearing aids. The types of hearing aids include in-ear aids, behind-ear aids, and canal aids.

These hearing aids are usually fitted to individual ears. Such fitting process includes several steps—measuring extent of hearing loss, determining gain of hearing aid, and adjusting frequency response of hearing aid. These steps are often performed by an audiologist, whose time spent on the fitting process is a significant cost associated with hearing aids. If the fitting process is not successful, the hearing aids are often returned to the manufacturers for full refunds. For example, the return rate may range from about 18% to 28%. Such high return rate can significantly increase costs of hearing aids, Hence it is desirable to improve techniques for fitting hearing aids.

BRIEF SUMMARY OF THE INVENTION

The present invention relates generally to acoustic devices. More specifically, the invention provides a method and system for automatically adjusting acoustic devices based on acoustic reflectance. For example, the acoustic reflectance is a relationship between reflected waves and incident waves. Merely by way of example, the invention has been applied to hearing aids, but it would be recognized that the invention has a much broader range of applicability.

An embodiment of the present invention provides a method for automatically adjusting a hearing aid. The method includes measuring an acoustic reflectance associated with an ear canal as a function of an incident pressure and an acoustic frequency, processing information associated with the measured acoustic reflectance, determining a reflectance slope based on, at least, information associated with the measured acoustic reflectance, and adjusting, at least, one parameter associated with the hearing aid based on, at least, information associated with the reflectance slope. The reflectance slope is associated with a reflectance component varying with the incident pressure.

According to another embodiment, a method for automatically adjusting a hearing aid includes measuring an acoustic reflectance associated with an ear canal as a function of an incident pressure and an acoustic frequency, processing information associated with the measured acoustic reflectance, determining a reflectance component based on at least information associated with the measured acoustic reflectance, and adjusting at least one parameter associated with the hearing aid based on at least information associated with the reflectance component. The reflectance component is substantially constant with respect to the incident pressure.

According to yet another embodiment, a method for automatically adjusting a hearing aid includes measuring an acoustic reflectance associated with an ear canal as a function of an incident pressure and an acoustic frequency, processing information associated with the measured acoustic reflectance, determining a first acoustic impedance related to the ear canal based on at least information associated with the measured acoustic reflectance, and adjusting a second acoustic impedance associated with the hearing aid based on at least information associated with the first acoustic impedance.

According to yet another embodiment, a method for automatically adjusting a hearing aid includes measuring an acoustic reflectance associated with an ear canal as a function of an incident pressure and an acoustic frequency, processing information associated with the measured acoustic reflectance, and determining a reflectance component based on at least information associated with the measured acoustic reflectance, measuring a reverse transfer function associated with the hearing aid from the ear canal to the hearing aid input microphone. Additionally, the method includes adjusting at least one parameter associated with the hearing aid based on at least information associated with the reflectance component and the reverse transfer function. For example, the reflectance component is substantially constant with respect to the incident pressure.

According to yet another embodiment, a system for providing hearing assistance with automatic adjustment includes a processing system, a control system coupled to the processing system, an earphone coupled to the control system, and a first microphone and a second microphone coupled to the processing system. The earphone and the first microphone are configured to be placed inside an ear canal. The earphone is configured to provided a plurality of impedance values.

According to yet another embodiment, a method for adjusting a hearing aid includes measuring a pressure associated with an ear canal, processing information associated with the measured pressure, determining a first acoustic characteristic based on at least information associated with the measured pressure, and adjusting a second acoustic characteristic based on at least information associated with the first acoustic impedance.

Many benefits are achieved by way of the present invention over conventional techniques. For example, some embodiments of the present invention can significantly lower the cost of hearing aid fitting and improve the quality of average patient fitting. For example, the variance in hearing aid fitting can be greatly reduced. Certain embodiments of the present invention can greatly reduce or remove the intervention of the hearing aid professional in some technically difficult and high-risk tasks for prescribing a hearing aid for a patient. This would allow the professional to focus on the patient rather than on aid-specific technical details. Some embodiments of the present invention provide a hearing aid that can automatically and in situ adjust compression parameters and frequency-dependent gain of the hearing aid. For example, the hearing aid performs the adjustment based on measurements the hearing aid makes in the ear, either automatically, in a scheduled manner, or when the hearing aid is manually instructed to do so. The manual instruction may be generated via some virtual button such as an electronic command. Certain embodiments of the present invention allow for the adjustment of the source impedance of the hearing aid as a function of acoustic pressure and frequency. For example, the source impedance is related to the acoustic impedance of the earphone of the hearing aid.

Some embodiments of the present invention improve the delivery of acoustic power or intensity to the ear canal and/or cochlea. Certain embodiments of the present invention can improve the hearing aid efficiency. Some embodiments of the present invention reduce the effect of standing waves by controlling the acoustic reflectance via a slowly-varying tonic change in driving-point impedance of the output transducer. For example, the output transducer is part of an earphone of the hearing aid. Certain embodiments of the present invention reduce and control "sing margins," also known as "feedback margins," defined as the amount of gain that may be provided before the hearing aid becomes unstable and starts to oscillate, or "whistle." For example, the sing margins depend on the acoustic reflectance, which in turn depends on the relative impedance between the earphone and the ear canal.

Some embodiments of the present invention provide significant improvements to clinical evaluation tools for hearing aid and also reduce the variability in the measurements. Certain embodiments of the present invention provide a hearing aid capable of measuring acoustic reflectance as a function of acoustic pressure and frequency. Some embodiments of the present invention use contra-lateral sound as the stimulus and the acoustic reflectance as the output control measure. For example, the reflectance change indicates the cochlear response to the contra-lateral stimulus, and serves as a measure for the status of inner hair cells and outer hair cells. Certain embodiments of the present invention provide a hearing aid that can automatically determine acoustic parameters of the hearing aid. For example, the acoustic parameters include ones of the earphone. As another example, the automatic determination is performed for the purpose of in-situ characterization of the middle and inner ear via the ear canal.

Some embodiments of the present invention can automatically adjust a hearing aid to the ear canal dynamically and without intervention on the part of the user. Certain embodiments of the present invention use the length and area of the ear canal for adjusting the hearing aid. For example, the length and area are determined during the making of the ear mold. As another example, the area of the ear canal is estimated based on the size of the ear tip used by the tester, which can be determined semi-automatically. Some embodiments of the present invention monitor changes of the ear and/or the hearing aid. For example, such changes reveal ear wax buildup, and/or colds and other minor inflammation of the middle ear. As another example, the monitoring is performed to detect middle ear infections in children with a history of middle ear problems. In yet another example, the monitoring is performed by a handheld device. In yet another example, the warnings and information can be delivered to the ear via a voice message delivered from the hearing aid.

Depending upon embodiment, one or more of these benefits may be achieved. These benefits and various additional objects, features and advantages of the present invention can be fully appreciated with reference to the detailed description and accompanying drawings that follow.

BRIEF DESCRIPTION OF THE DRAWINGS

FIG. 4(*b*) is a simplified diagram for adjusting a hearing aid according to yet another embodiment of the present invention;

DETAILED DESCRIPTION OF THE INVENTION

The present invention relates generally to acoustic devices. More specifically, the invention provides a method and system for automatically adjusting acoustic devices based on acoustic reflectance. For example, the acoustic reflectance is a relationship between reflected waves and incident waves. Merely by way of example, the invention has been applied to hearing aids, but it would be recognized that the invention has a much broader range of applicability.

The fitting of conventional hearing aids is a complicated process. For example, the fitting personnel needs to perform a detailed analysis of middle ear and cochlear loss configuration. This analysis is made more difficult by the presence of standing waves in the ear canal due to reflection from the middle and/or inner ears. For example, such analysis may require an acoustic power assessment, which in turn includes detailed acoustic impedance measurements and analyses of both the hearing aid and of the ear canal. While such impedance measurements are possible, it is often not practical to provide this information either in the clinic, or in situ. Training a large number of hearing aid fitting personnel is often a large cost for delivering such technology.

Additionally, conventional hearing aids often use multiband compression which includes dynamic range compression as a function of frequency. Determining the compression parameters is a complex task, and one that is prone to error. Moreover, this complexity of the fitting process often requires advanced training for fitting personnel, and such training usually varies with different types of hearing aids. Hence an automated fitting process is highly desirable.

According to certain embodiments of the present invention, the fitting process is automated by providing a hearing aid that can automatically adjust its parameters to the hearing impaired ear, in situ. Additionally, such hearing aid can improve the overall quality of a hearing aid fitting, efficiency of hearing compensation, and/or delivery of acoustic signals to cochlea. Moreover, such a hearing aid can reduce effect of standing waves and/or control feedback margins. For example, the feedback margins are related to the amount of gain that may be provided before a hearing aid becomes unstable and starts to oscillate or "whistle," which depends on the acoustic properties of the hearing aid.

Figure 1:
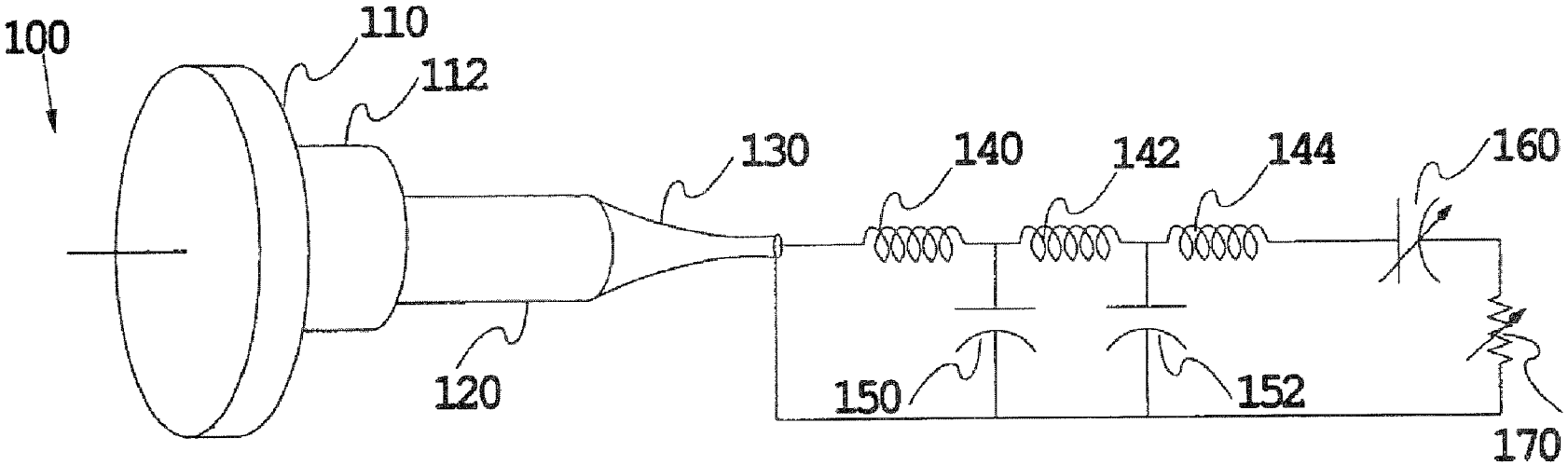
Fig. 1 PRIOR ART
FIG. 1 is a simplified conventional circuit diagram modeling a human ear.

FIG. 1 is a simplified conventional circuit diagram modeling a human ear. The circuit 100 includes transmission lines 110, 112, 120, and 130, inductors 140, 142, and 144, capacitors 150 and 152, an adjustable capacitor 160, and an adjustable impedance 170. Each inductor represents a mass, such as a middle ear bone, and each capacitor represents a stiffness or ligament, which connects the bones together. The transmission lines 110, 112, 120, and 130 represent the outer ear, the ear canal, and the ear drum. For example, the ear drum may impose a 37-μs delay to acoustic signals received by the out ear. In another example, the inductors 140, 142, and 144 model the mass of the malleus, the incus, and the stapes respectively. The adjustable capacitor 160 models the stiffness of the annular ligament, and the adjustable impedance 170 models the impedance.

Figure 2:
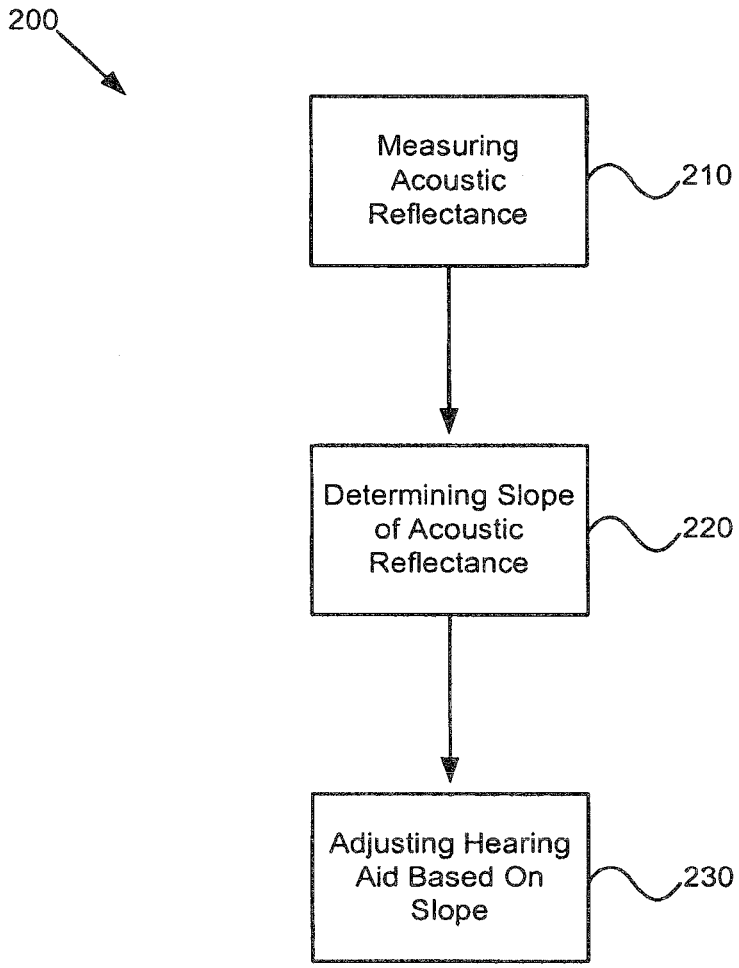
FIG. 2 is a simplified diagram for adjusting a hearing aid according to an embodiment of the present invention.

FIG. 2 is a simplified diagram for adjusting a hearing aid according to an embodiment of the present invention. This diagram is merely an example, which should not unduly limit the scope of the claims herein. One of ordinary skill in the art would recognize many variations, alternatives, and modifications. The method 200 includes a process 210 for measuring acoustic reflectance, a process 220 for determining slope of acoustic reflectance, and a process 230 for adjusting hearing aid based on slope. Although the above has been shown using a selected sequence of processes, there can be many alternatives, modifications, and variations. For example, some of the processes may be expanded and/or combined. Other processes may be inserted to those noted above. For example, the process 210 is performed after placing at least a part of a hearing aid into an ear canal. Depending upon the embodiment, the specific sequence of processes may be interchanged with others. In one embodiment, the processes 210, 220, and 230 are performed automatically by signal processing components of the hearing aid without any human intervention. Further detail of the present invention can be found throughout the present specification and more particularly below.

At the process 210, the acoustic reflectance is measured. In one embodiment, the measurement of the acoustic reflectance includes measuring the incident pressure and the reflected pressure in the ear canal as functions of frequency. For example, the reflected pressure comes from the eardrum and the cochlea. If the incident pressure is represented by $P^+$ and the reflected pressure is represented by $P^-$, the acoustic reflectance R is determined as follows:

$$R(f) = \frac{P^-(f)}{P^+(f)} \quad \text{(Equation 1)}$$

where f is the frequency of acoustic signals. R is a complex number that can be described by the magnitude |R| and the phase ∠R. The square of |R| is equal to the power reflectance, and the latency $\tau^-$ of the acoustic reflectance R can be determined as follows:

$$\tau^- = -\frac{1}{2\pi}\frac{\partial \angle R}{\partial f} \quad \text{(Equation 2)}$$

In another embodiment, the reflected pressure $P^-$ is measured in response to different levels of the incident pressure $P^+$. The measured R is not only a function of frequency but also a function of $P^+$ as shown below.

$$R(P^+, f) = \frac{P^-(P^+, f)}{P^+(f)} \quad \text{(Equation 3)}$$

In yet another embodiment, the characteristic impedance $z_0$ of the ear canal is defined as follows:

$$z_0 \equiv \rho c / A_{ec} \quad \text{(Equation 4)}$$

where ρ is the density of air, c is the speed of sound, and $A_{ec}$ is the cross-sectional area of the ear canal. The acoustic impedance $Z_{ec}$ of the ear canal is determined as a ratio of total pressure P to total volume velocity U, namely:

$$Z_{ec} = \frac{P}{U} = \frac{P^+ + P^-}{U^+ - U^-} \quad \text{(Equation 5)}$$

where $U^+$ and $U^-$ are incident and reflected volume velocities respectively. Given the incident pressure $P^+$ and the reflected pressure $P^-$, the incident and reflected volume velocities can be determined as follows:

$$U^+ = \frac{P^+}{z_0} \quad \text{(Equation 6)}$$

$$U^- = \frac{P^-}{z_0} \quad \text{(Equation 7)}$$

Accordingly, Equation 5 is transformed into the following:

$$Z_{ec} = z_0 \frac{1 + R}{1 - R} \quad \text{(Equation 8)}$$

As shown in Equation 8, the acoustic impedance $Z_{ec}$ ($P^+$, f) of the ear canal depends on the acoustic reflectance R ($P^+$, f) as determined by Equation 1 or Equation 3.

In yet another embodiment, measurements of the incident pressure and the reflected pressure are performed under high noise environments. Accordingly, narrow band signals are used by employing narrow band chirps and noise or pure tones of various durations, in order to improve the ability of rejecting noise.

In yet another embodiment, measurements of the incident pressure and the reflected pressure are performed with reflectance otoacoustic emissions techniques. With these techniques, the incident sound is removed and the reflected sound is measured directly in order to remove or reduce stimulus artifact problems.

At the process 220, a slope of the acoustic reflectance R is determined. In one embodiment, the measured R is a function of frequency f and $P^+$, and includes a constant component $R_0$ and a slope $R_1$. $R_0$ is independent of $P^+$, and $R_1$ varies with $P^+$. $R_0$ and $R_1$ each may vary with the frequency f. At the process 220, the slope $R_1$ is determined. For example, a Taylor series expansion of R with respect to $P^+$ can be performed as follows:

$$R(P^+,f) \approx R_0(f)+R_1(f)\times P^+ + R_2(f)\times (P^+)^2 \quad \text{(Equation 9)}$$

where $R_0$, $R_1$, and $R_2$ each may vary with the frequency f. As another example, the reflectance R is substantially equal to a first constant $R_0$ (f) if $P^+$ is lower than about 30 dB-SPL, and substantially equal to a second constant if $P^+$ is higher than about 50 dB-SPL. 1 dB-SPL is equal to $$20\times\log_{10}\left(\frac{P^+ + P^-}{P_{ref}}\right),$$

and $P_{ref}$ is equal to $20\times10^{-6}$ Pascals. The first constant is larger than the second constant. For incident pressure $P^+$ that falls between 30 and 50 dB-SPL, the acoustic reflectance R varies with $P^+$, for example, monotonically. In another example, each of the first constant and the second constant varies with the frequency f.

At the process 230, the hearing aid is adjusted in response to the slope of acoustic reflectance. In one embodiment, the slope of the measured reflectance is used to determine the amplitude compression parameters of the hearing aid. For example, the parameters include the compression slope and break points for multi-band compression. As another example, the compression is determined as a function of frequency based on the slope $R_1$ (f).

In another embodiment, the slope of the acoustic reflectance can provide information about cochlear outer hair cells. For example, the dependence of the slope on incident pressure may result from characteristics of cochlear outer hair cells. If these cells are damaged, the dependence can be greatly reduced. As an example, if the cochlear outer hair cells are totally destroyed, the slope $R_1$ (f) of the acoustic reflectance can disappear. Therefore, the degree of compression applied by the hearing aid should increase as the amount of dependence decreases. In yet another example, if the ear shows a normal slope $R_1$ (f) for acoustic reflectance, no compression is added. If the ear does not show any non-zero slope, a gain decreases monotonically on a dB scale, between an input level ranging from 20 to 65 dB-SPL. For example, at an input level of 65 dB-SPL, a minimum gain is provided. At an input level of 20 dB-SPL, a full gain is provided. For an input level decreasing from 65 to 20 dB-SPL, the gain increases linearly on a dB scale from zero to the full gain respectively.

In yet another embodiment, the gain depends on frequency at a given input level. For example, the gain that compensates for presbycusis at low frequency such as 1 kHz is smaller than that at high frequency. In yet another embodiment, the gain that compensates for presbycusis is smaller than that for conductive loss at low frequency such as 1 kHz due to, for example, a hole in the eardrum.

Figure 3:
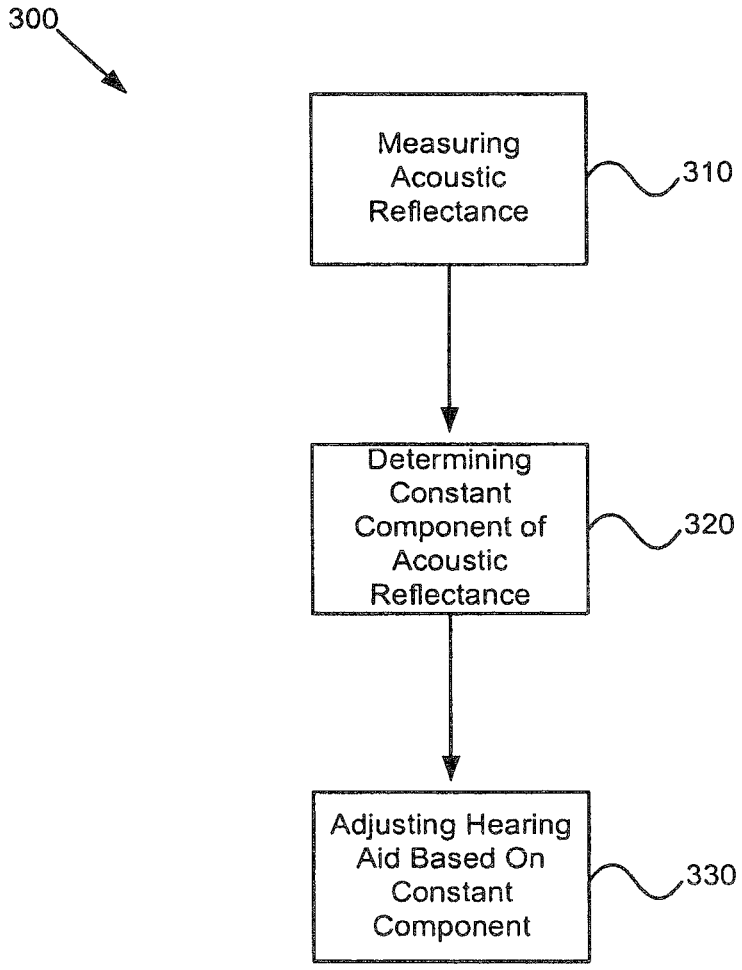
FIG. 3 is a simplified diagram for adjusting a hearing aid according to another embodiment of the present invention.

FIG. 3 is a simplified diagram for adjusting a hearing aid according to another embodiment of the present invention. This diagram is merely an example, which should not unduly limit the scope of the claims herein. One of ordinary skill in the art would recognize many variations, alternatives, and modifications. The method 300 includes a process 310 for measuring acoustic reflectance, a process 320 for determining constant component of acoustic reflectance, and a process 330 for adjusting hearing aid based on the constant component. Although the above has been shown using a selected sequence of processes, there can be many alternatives, modifications, and variations. For example, some of the processes may be expanded and/or combined. Other processes may be inserted to those noted above. For example, the process 310 is performed after placing at least a part of a hearing aid into an ear canal. Depending upon the embodiment, the specific sequence of processes may be interchanged with others replaced. In one embodiment, the processes 310, 320, and 330 are performed automatically without any human intervention. Future detail of the present invention can be found throughout the present specification and more particularly below.

The process 310 for measuring acoustic reflectance is substantially similar to the process 210 as described above. At the process 320, a constant component of the acoustic reflectance R is determined. In one embodiment, the measured R is a function of frequency and $P^+$, and includes a constant component $R_0$ and a slope $R_1$. $R_0$ is independent of $P^+$, and $R_1$ varies with $P^+$. $R_0$ and $R_1$ each may vary with the frequency f. At the process 320, the constant component $R_0$ is determined.

For example, $R_0$ and $R_1$ are determined by performing a Taylor series expansion of R with respect to $P^+$ as shown in Equation 9. $R_0$ and $R_1$ each may still vary with the frequency f. As another example, the reflectance R is substantially equal to a first constant $R_0$ (f) if $P^+$ is lower than about 30 dB-SPL, and substantially equal to a second constant if $P^+$ is higher than about 50 dB-SPL. The first constant is larger than the second constant. For incident pressure $P^+$ that falls between 30 and 50 dB-SPL, the acoustic reflectance R varies with $P^+$, for example, monotonically. In another example, each of the first constant and the second constant varies with the frequency f.

At the process 330, the hearing aid is adjusted in response to the constant component of acoustic reflectance. The constant component is constant with respect to $P^+$, but may still vary with the frequency f. In one embodiment, the constant component is used to determine overall frequency response of the hearing aid. In another embodiment, the constant component is used to determine acoustic impedance of the hearing aid. In yet another embodiment, the constant component of the acoustic reflectance can provide information about the middle ear. As an example, for incident pressure above about 65 dB-SPL, the gain of the hearing aid should be determined from the constant component. The gain needs to match the absorbed intensity as a function of frequency with a gain of unity. In another example, if the middle ear reflects more energy, the gain would be raised to make the absorbed intensity, equal to that of the normal middle ear and cochlea at any given level.

As discussed above and further emphasized here, FIGS. 2 and 3 are merely examples, which should not unduly limit the scope of the claims herein. One of ordinary skill in the art would recognize many variations, alternatives, and modifications. For example, the two embodiments as described in FIGS. 2 and 3 can be combined. In one embodiment, the process 230 is used to determine the gain for incident pressure lower than about 65 dB-SPL, and the process 330 is used to determine the gain for incident pressure higher than about 65 dB-SPL.

Figure 4A:
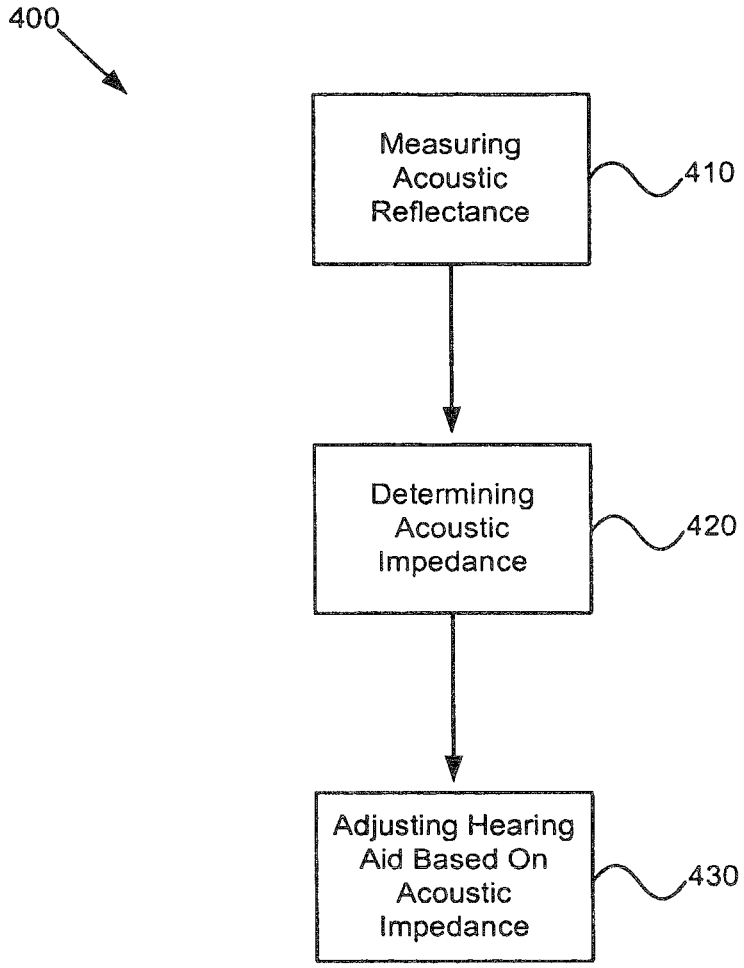
FIG. 4(*a*) is a simplified diagram for adjusting a hearing aid according to yet another embodiment of the present invention.
Figure 4B:
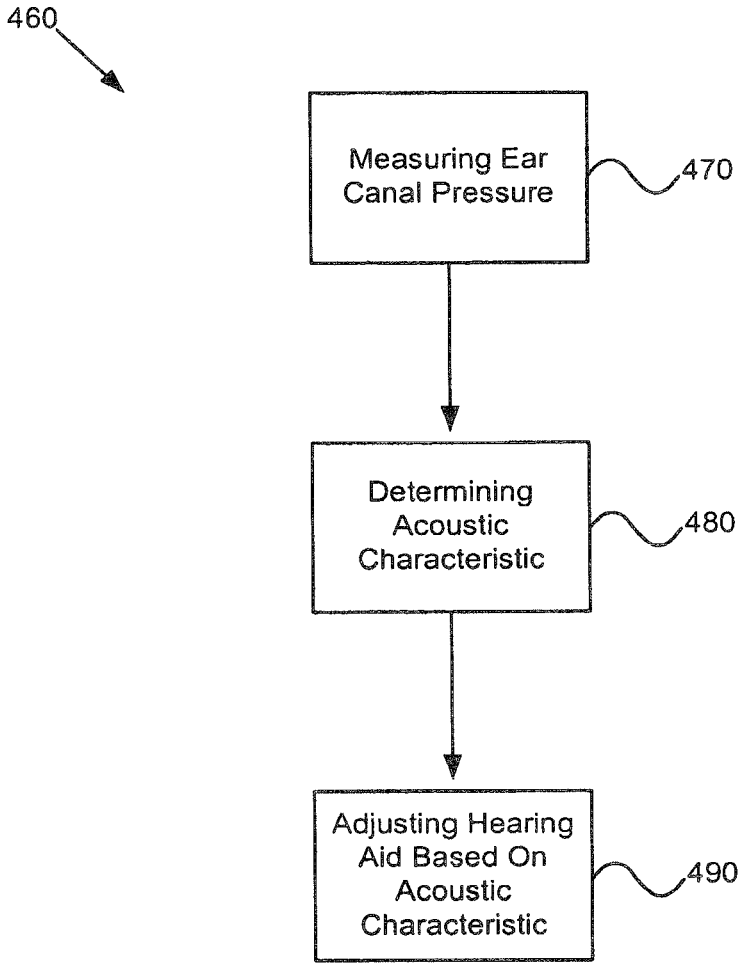

FIG. 4(*a*) is a simplified diagram for adjusting a hearing aid according to yet another embodiment of the present invention. This diagram is merely an example, which should not unduly limit the scope of the claims herein. One of ordinary skill in the art would recognize many variations, alternatives, and modifications. The method 400 includes a process 410 for measuring acoustic reflectance, a process 420 for determining acoustic impedance, and a process 430 for adjusting hearing aid based on acoustic impedance. Although the above has been shown using a selected sequence of processes, there can be many alternatives, modifications, and variations. For example, some of the processes may be expanded and/or combined. Other processes may be inserted to those noted above. Depending upon the embodiment, the specific sequence of processes may be interchanged with others replaced. Future detail of the present invention can be found throughout the present specification and more particularly below.

The process 410 for measuring acoustic reflectance is substantially similar to the process 210 as described above. At the process 420, the acoustic impedance $Z_{ec}$ of the ear canal is determined from the measured acoustic reflectance R. Based on Equation 8, $Z_{ec}$ and R have the following relation:

$$R = \frac{Z_{ec} - z_0}{Z_{ec} + z_0} \quad \text{(Equation 10)}$$

wherein $z_0$ is the characteristic impedance $z_0$ of the ear canal as described in Equation 4.

At the process 430, the hearing aid is adjusted based on acoustic impedance of the ear canal. In one embodiment, the hearing aid includes a receiver with an acoustic impedance. For example, the receiver is an earphone. The acoustic impedance of the receiver is adjusted based on the acoustic impedance of the ear canal. In another embodiment, the impedance of the hearing aid is adjusted to become equal to the impedance $Z_{ec}$ of the ear canal. For example, standing waves in the ear canal are mitigated. As another example, retrograde wave $P^-(f)$ that comes back from the ear is absorbed in the receiver, and the reflectance of such a retrograde wave is modified.

FIG. 4(*b*) is a simplified diagram for adjusting a hearing aid according to yet another embodiment of the present invention. This diagram is merely an example, which should not unduly limit the scope of the claims herein. One of ordinary skill in the art would recognize many variations, alternatives, and modifications. The method 460 includes a process 470 for measuring ear canal pressure, a process 480 for determining acoustic characteristic, and a process 490 for adjusting hearing aid based on acoustic characteristic. Although the above has been shown using a selected sequence of processes, there can be many alternatives, modifications, and variations. For example, some of the processes may be expanded and/or combined. Other processes may be inserted to those noted above. Depending upon the embodiment, the specific sequence of processes may be interchanged with others replaced. Future detail of the present invention can be found throughout the present specification and more particularly below.

At the process 470, the ear canal pressure is measured. For example, the ear canal pressure is a sum of the incident pressure and the reflected pressure. At the process 480, an acoustic characteristic is determined based on the measured ear canal pressure. In one embodiment, the acoustic characteristic includes the acoustic reflectance. The acoustic reflectance is determined by a process substantially similar to the process 210. In another embodiment, the acoustic characteristic includes the acoustic impedance of the ear canal. The acoustic impedance is determined by a process substantially similar to the process 420.

At the process 490, the hearing aid is adjusted based on acoustic characteristic. In one embodiment, the acoustic characteristic includes the acoustic impedance. The adjustment is performed by a process substantially similar to the process 430. In another embodiment, the acoustic characteristic includes the acoustic reflectance. The acoustic reflectance is adjusted to optimize a performance metric of the hearing aid. For example, the performance metric is related to standing waves in the ear canal. The standing waves are mitigated. As another example, the performance metric is related to retrograde wave $P^-(f)$ that comes back from the ear which is absorbed in the receiver. The reflectance of such a retrograde wave is modified. As yet another example, the power transferred to the ear canal is increased or maximized.

Figure 5:
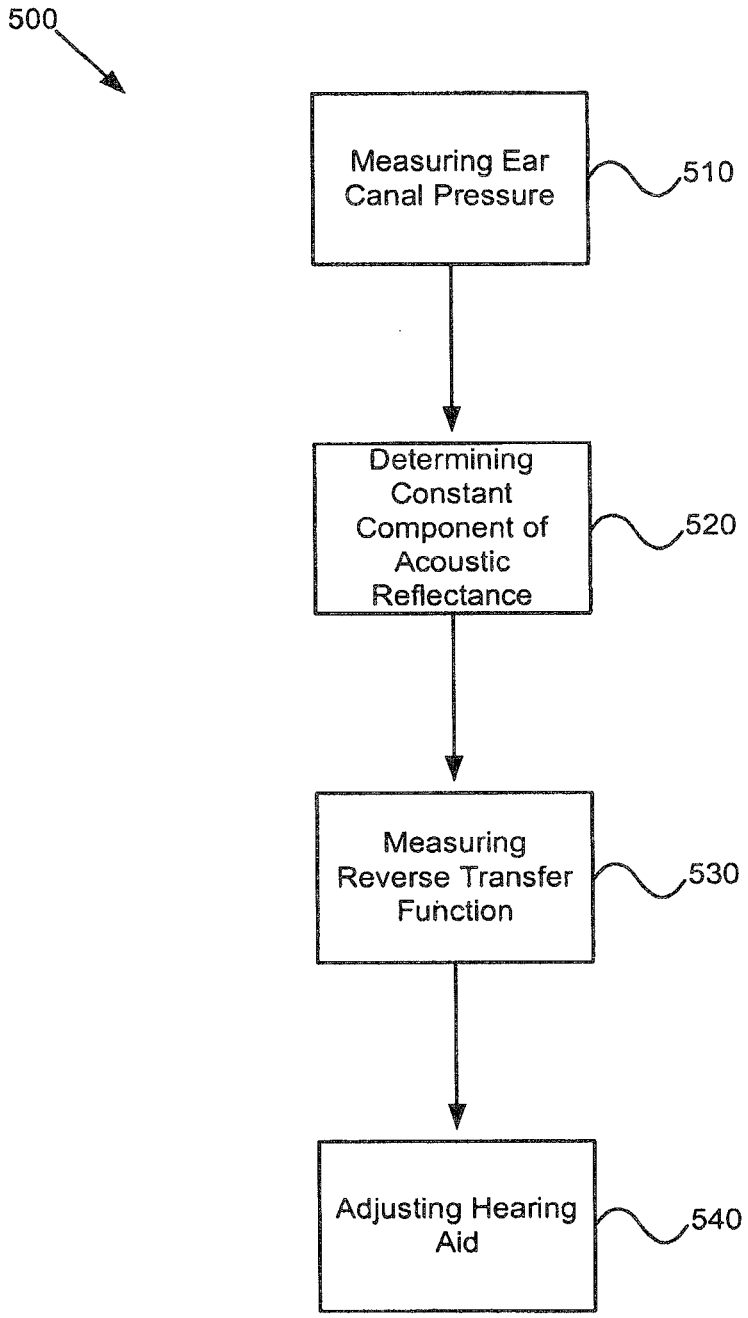
FIG. 5 is a simplified diagram for adjusting a hearing aid according to yet another embodiment of the present invention.

FIG. 5 is a simplified diagram for adjusting a hearing aid according to yet another embodiment of the present invention. This diagram is merely an example, which should not unduly limit the scope of the claims herein. One of ordinary skill in the art would recognize many variations, alternatives, and modifications. The method 500 includes a process 510 for measuring ear canal pressure, a process 520 for determining constant component of acoustic reflectance, a process 530 for measuring reverse transfer function, and a process 540 for adjusting hearing aid. Although the above has been shown using a selected sequence of processes, there can be many alternatives, modifications, and variations. For example, some of the processes may be expanded and/or combined. Other processes may be inserted to those noted above. Depending upon the embodiment, the specific sequence of processes may be interchanged with others replaced. For example, the process 530 is performed prior to the process 510 and/or the process 520. Future detail of the present invention can be found throughout the present specification and more particularly below.

At the process 510, the ear canal pressure is measured. For example, the ear canal pressure is a sum of the incident pressure and the reflected pressure. In another example, the process 510 includes a process for determining an acoustic reflectance. The process for determining an acoustic reflectance is substantially similar to the process 210 as described above. The process 520 for determining constant component of acoustic reflectance is substantially similar to the process 320. At the process 530, a reverse transfer function is measured for the hearing aid. For example, the reverse transfer function of the hearing aid, from ear canal to the input microphone, is determined from a microphone inside the ear canal to a microphone outside the ear canal.

At the process 540, the hearing aid is adjusted. For example, the earphone source impedance is adjusted based on reverse transfer function and the constant component of acoustic reflectance. In one embodiment, the hearing aid includes a receiver with an acoustic impedance. For example, the receiver is an earphone. The acoustic impedance of the receiver is adjusted based on the reverse transfer function and constant component of acoustic reflectance. For example, the feedback from the ear canal to a microphone outside the ear canal is reduced by enhancing the stability condition such as the Nyquist stability criterion. As another example, the reflected or retrograde waves coming back from the ear are reduced or removed at particular frequencies and for specific phases which are favorable to oscillations. Such oscillation may otherwise result from high gain of the hearing aid. As yet another example, the gain of the hearing aid is adjusted. The gain includes a magnitude and a phase. In one embodiment, the sing margin of the hearing aid is controlled.

As discussed above and further emphasized here, FIGS. 2, 3, 4(*a*) and (*b*), and 5 are merely examples, which should not unduly limit the scope of the claims herein. One of ordinary skill in the art would recognize many variations, alternatives, and modifications. In one embodiment, the acoustic reflectance is measured, and the power reflectance is determined. The power reflectance is equal to the square of the magnitude of the acoustic reflectance R. In response, the hearing aid is adjusted to match the measured power reflectance to that of a normal ear at various frequencies. For example, the adjustment is performed at an incident pressure of 50 dB-SPL. As another example, the adjustment is performed by changing the acoustic impedance of a receiver of the hearing aid. The receiver is usually an earphone.

Certain embodiments of the present invention can dynamically tune the impedance of the output transducer 724 to the input impedance of the canal. A special earphone 620 having a multiplicity of taps along the coil 622 could be used to allow for the dynamic change in acoustic impedance in the subjects ear, depending on the load on that ear. By signal processing means 732, different signals can be delivered to the different taps 624, 626, thereby changing the receiver acoustic source impedance, as a function of frequency, and if necessary, level. Each tap of the coil would be driven by a digital to analogue converter which would be fed by the output of a digital filter bank combination. Feedback conditions would be measured and the impedance of the hearing aid earphone would be varied to minimize feedback, by reducing the energy reflectance at and near the frequencies where the feedback was determined to occur, via the multi-tapped coil in the earphone.

In yet another embodiment, various characteristics of the ear or the hearing aid and their changes over time are monitored and used to identify problems with the ear or the hearing aid. For example, the change of $Z_{ec}$ over time provides information on functional changes of the ear canal. As another example, the change of reverse transfer function over time may reveal leakage in the seal of the hearing aid in the ear canal. The reverse transfer function may be measured with a microphone inside the ear canal relative to a microphone outside the ear canal. In yet another example, the change of forward transfer function over time reveals wax buildup in the ear canal. The forward transfer function may be measured with a microphone outside the ear canal relative to a microphone inside the ear canal. In yet another example, the change of impedance of earphone over time reveals wax buildup on the earphone.

Figure 6:
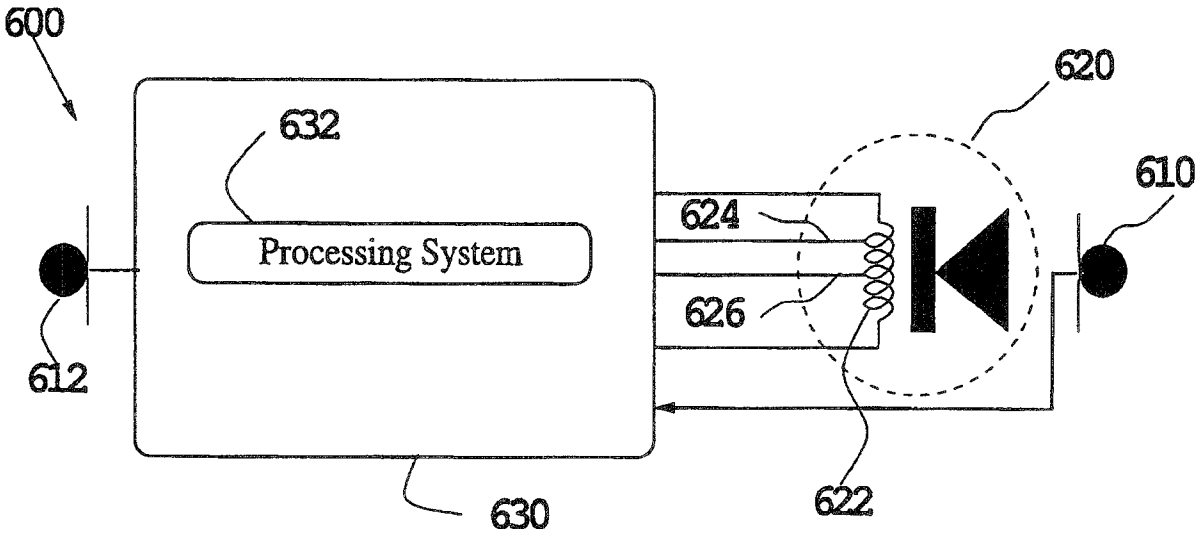
FIG. 6 is a simplified hearing aid according to an embodiment of the present invention.

FIG. 6 is a simplified hearing aid according to an embodiment of the present invention. This diagram is merely an example, which should not unduly limit the scope of the claims. One of ordinary skill in the art would recognize many variations, alternatives, and modifications. A system 600 includes microphones 610 and 612, an earphone 620, a system 630 including a processing system 632. Although the above has been shown using a selected group of apparatuses for the hearing aid 600, there can be many alternatives, modifications, and variations. For example, some of the apparatuses may be expanded and/or combined. Other apparatuses may be inserted to those noted above. Depending upon the embodiment, the arrangement of apparatuses may be interchanged with others replaced. The system 600 can be used to perform the methods 200, 300, 400, 460, and/or 500. Further details of these apparatuses are found throughout the present specification and more particularly below.

The earphone 620 can be used to output an acoustic pressure. In one embodiment, the earphone 620 includes at least a coil 622 and a plurality of taps along the coil 622. For example, the plurality of taps includes taps 624 and 626. The electrical impedance of the coil may be varied by controlling the plurality of taps as a function of acoustic pressure and frequency. By varying the electrical impedance, the acoustic impedance of the earphone can change correspondingly. For example, the acoustic impedance is adjusted through the plurality of taps on the receiver coil 622. In another example, the mid-frequency region needs an acoustic impedance that is close to the characteristic impedance $z_0$ of the ear canal, while at low frequencies, a higher impedance is needed to match the increased stiffness of the eardrum at those frequencies.

In one embodiment, each tap of the earphone 620 is driven by a digital to analog converter. The digital to analog converter receives the output of a digital filter bank combination. In another embodiment, different electrical signals are delivered to different taps of the earphone 620. Accordingly, the acoustic impedance of the earphone 620 can be changed as a function of acoustic pressure and frequency. In yet another embodiment, the earphone 620 can be placed into the ear canal and output an incident pressure to the ear drum.

The microphone 610 can be placed into the ear canal and receives an acoustic pressure. For example, the received acoustic pressure is reflected in response to the incident pressure from the earphone 620. The microphone 612 can be placed in the outer ear and receive acoustic signals. For example, the microphone 612 is an input microphone of the hearing aid 600.

The system 630 includes various electronic components, such as the processing system 632. In one embodiment, the processing system 632 can perform signal processing and computation. For example, the processing system 632 can select an incident acoustic pressure, instruct the earphone 620 to output such an acoustic pressure, and/or determine the acoustic reflectance based on the reflected acoustic pressure received by the microphone 610. In another embodiment, the processing system 632 allows for measurements of the power absorbed by and reflected from the ear canal as a function of incident acoustic pressure and frequency. In yet another embodiment, the processing system 632 can perform analysis and control functions as described for various embodiments in FIGS. 2, 3, 4(*a*) and (*b*), and 5. For example, the processing system 632 is used for measuring acoustic reflectance and acoustic impedance of the ear canal and processing the measurement results to determine fitting parameters of the hearing aid. In yet another embodiment, the processing system 632 in addition to other components delivers different electrical signals to different taps of the earphone 620. Accordingly, the acoustic impedance of the earphone 620 can be changed as a function of acoustic pressure and frequency.

As discussed above and further emphasized here, FIG. 6 is merely an example, which should not unduly limit the scope of the claims herein. One of ordinary skill in the art would recognize many variations, alternatives, and modifications. In one embodiment, the processing system 632 is not integrated with other components of the system 630 respectively. For example, the signal processing is performed outside the ear for measuring acoustic reflectance and acoustic impedance of the ear canal and processing the measurement results to determine fitting parameters of the hearing aid. As another example, the processing system 632 includes the measurement equipment by Mimosa Acoustics, Inc., and/or use one or more Matlab® programs. In another embodiment, the processing system 632 includes a digital signal processing system that is external to the ear. For example, the digital signal processing system can be worn on a body pack. Alternatively, the digital signal processing system is connected with other components of the system 630 through a wireless connection, such as a Blue Tooth wireless link.

Figure 7:
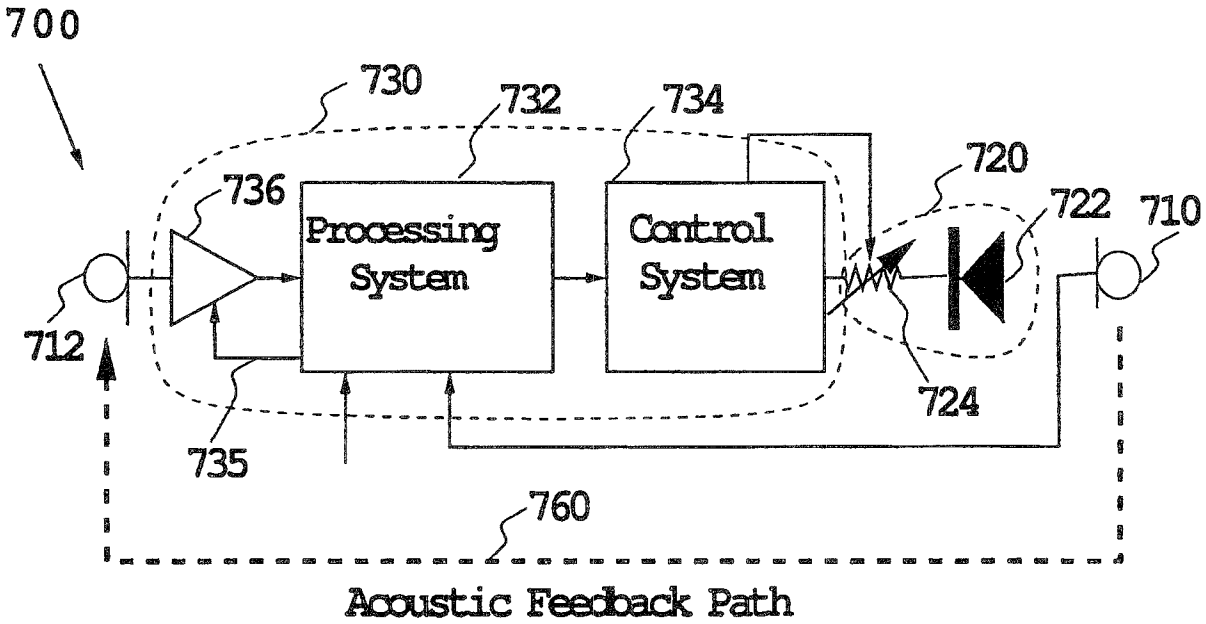
FIG. 7 is a simplified hearing aid according to another embodiment of the present invention.

FIG. 7 is a simplified hearing aid according to another embodiment of the present invention. This diagram is merely an example, which should not unduly limit the scope of the claims. One of ordinary skill in the art would recognize many variations, alternatives, and modifications. A system 700 includes microphones 710 and 712, an earphone 720, a system 730 including a processing system 732, a control system 734 and an amplifier 736. Although the above has been shown using a selected group of apparatuses for the hearing aid 700, there can be many alternatives, modifications, and variations. For example, some of the apparatuses may be expanded and/or combined. Other apparatuses may be inserted to those noted above. Depending upon the embodiment, the arrangement of apparatuses may be interchanged with others replaced. The system 700 can be used to perform the methods 200, 300, 400, 460, and/or 500. Further details of these apparatuses are found throughout the present specification and more particularly below.

The earphone 720 can be used to output an acoustic pressure. In one embodiment, the earphone 720 includes a speaker 722 and an adjustable impedance 724. For example, the earphone 720 is configured to provide a plurality of impedance values. In another example, the adjustable impedance 724 includes the coil 622 and the plurality of taps along the coil 622. The electrical impedance 724 may be varied as a function of acoustic pressure and frequency. By varying the electrical impedance, the acoustic impedance of the earphone 720 can change correspondingly. For example, the mid-frequency region needs an acoustic impedance that is close to the characteristic impedance $z_0$ of the ear canal, while at low frequencies, a higher impedance is needed to match the increased stiffness of the eardrum at those frequencies.

The microphone 710 can be placed into the ear canal and receives an acoustic pressure. For example, the received acoustic pressure is reflected in response to the incident pressure from the earphone 720. The microphone 712 can be placed in the outer ear and receive acoustic signals. For example, the microphone 712 is an input microphone of the hearing aid 700. In another example, the acoustic impedance of the ear phone 720 is adjusted to control power delivered to the ear canal. Such control can improve the energy transferred to the ear canal, reduce the power delivered to the microphone 712, and/or reduce the acoustic feedback.

The system 730 includes a processing system 732, a control system 734 and an amplifier 736. The amplifier 736 receives electrical signals from the microphone 712 and interacts with the processing system 732. The processing system sends signals to the control system 734 and receives signals from the microphone 710 and other sources. For example, the signal from the microphone 712 indicates the received acoustic pressure. The control system 734 outputs control signals to the earphone 720. In one embodiment, the control system 734 includes one or more digital-to-analog converters. In response to the control signals, the acoustic impedance of the earphone 720 can be changed as a function of acoustic pressure and frequency. In yet another embodiment, the earphone 720 can be placed into the ear canal and output an incident pressure to the ear drum.

The processing system 732 can perform signal processing and computation. In one embodiment, the processing system 732 can select an incident acoustic pressure, instruct the earphone 720 to output such an acoustic pressure, and/or determine the acoustic reflectance based on the reflected acoustic pressure received by the microphone 710. In another embodiment, the processing system 732 allows for measurements of the power absorbed by and reflected from the ear canal as a function of incident acoustic pressure and frequency. In yet another embodiment, the processing system 732 and the control system 734 can perform analysis and control functions as described for various embodiments in FIGS. 2, 3, 4(*a*) and (*b*), and 5. For example, the processing system 732 and the control system 734 are used for measuring acoustic reflectance and acoustic impedance of the ear canal and processing the measurement results to determine fitting parameters of the hearing aid. In yet another embodiment, the processing system 732 and the control system 734 deliver electrical signals so that the acoustic impedance of the earphone 720 can be changed as a function of acoustic pressure and frequency. The amplifier 736 can provide a variable gain, such as from 0 to 50 dB, that is controlled by the signal 735.

As discussed above and further emphasized here, FIG. 7 is merely an example, which should not unduly limit the scope of the claims herein. One of ordinary skill in the art would recognize many variations, alternatives, and modifications. In one embodiment, the processing system 732 is not integrated with other components of the system 730 respectively. For example, the signal processing is performed outside the ear for measuring acoustic reflectance and acoustic impedance of the ear canal and processing the measurement results to determine fitting parameters of the hearing aid. As another example, the processing system 732 includes the measurement equipment by Mimosa Acoustics, Inc., and/or use one or more Matlab programs. In another embodiment, the processing system 732 includes a digital signal processing system that is external to the ear. For example, the digital signal processing system can be worn on a body pack. Alternatively, the digital signal processing system is connected with other components of the hearing aid 700 through a wireless connection, such as a Blue Tooth wireless link.

The system 700 can be used to perform the methods 200, 300, 400, 460, and/or 500. As shown in FIG. 7, there exists an acoustic feedback path 760. The feedback path 760 is only illustrative without specifying its physical locations. For example, the feedback path may traverse through the control system 734. In another example, to perform the method 500, the process 530 for measuring reverse transfer function includes certain processes as shown in FIG. 8.

Figure 8:
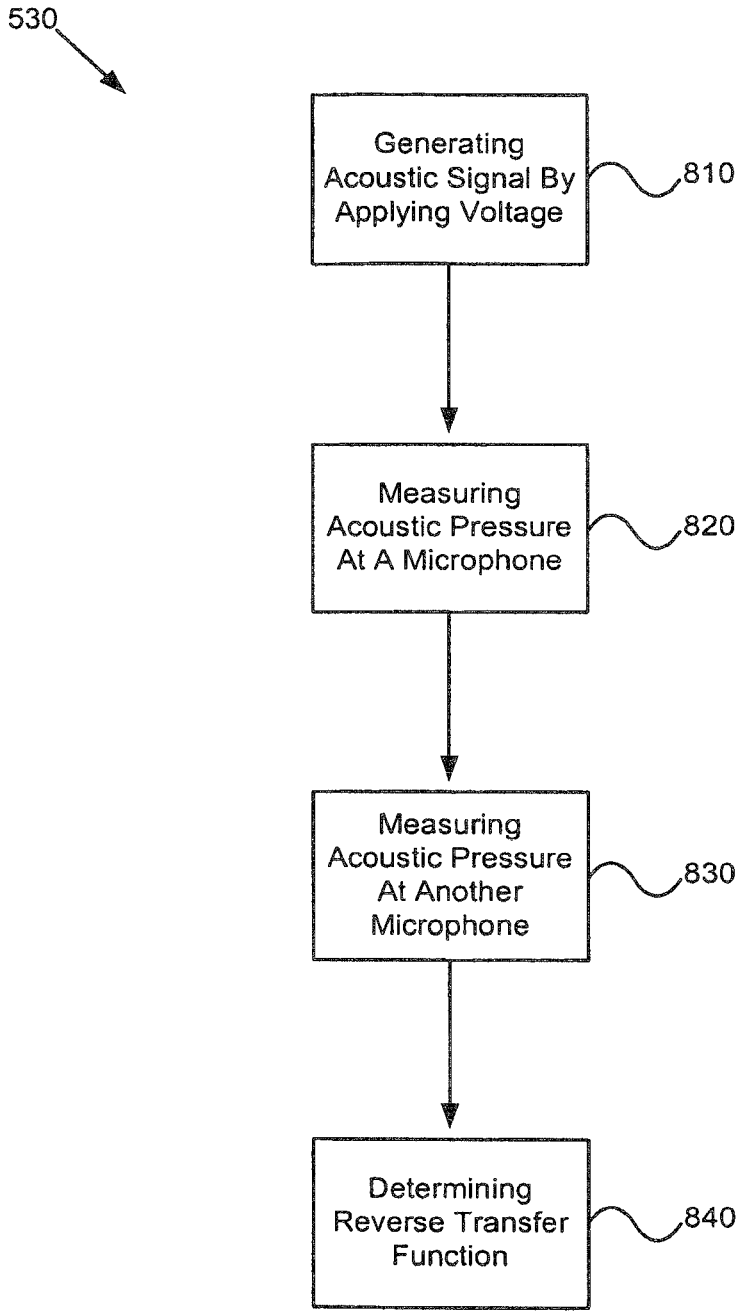
FIG. 8 is a simplified process for measuring reverse transfer function according to an embodiment of the present invention.

FIG. 8 is a simplified process 530 for measuring reverse transfer function according to an embodiment of the present invention. This diagram is merely an example, which should not unduly limit the scope of the claims herein. One of ordinary skill in the art would recognize many variations, alternatives, and modifications. As discussed above, the process 530 includes a process 810 for generating acoustic signal by applying voltage to the earphone 720, a process 820 for measuring acoustic pressure at the microphone 710, a process 830 for measuring acoustic pressure at the microphone 712, and a process 840 for determining reverse transfer function. Although the above has been shown using a selected sequence of processes, there can be many alternatives, modifications, and variations. For example, some of the processes may be expanded and/or combined. Other processes may be inserted to those noted above. Depending upon the embodiment, the specific sequence of processes may be interchanged with others replaced.

For example, the process 830 is performed prior to the process 820. In one embodiment, the earphone 720 and the microphone 710 are placed in the ear canal, and the microphone 712 are placed in the outer ear. In another embodiment, the reverse transfer function is equal to a ratio in the frequency domain the measured acoustic pressure at the microphone 712 to the measured acoustic pressure at the microphone 710.

As discussed above, the hearing aid 600 and/or 700 can be used to perform the method 200, 300, 400, 460, and/or 500 automatically. In one embodiment, the hearing aid 600 and/or 700 is placed in the ear. For example, a microphone and a earphone of the hearing aid are placed in the ear canal and another microphone of the hearing aid is placed in the outer ear. In another embodiment, prior to placement of the hearing aid in the ear, the hearing aid is calibrated. For example, the calibration includes determining the Thévenin/Norton parameters as a function of frequency. In another example, the calibration includes measuring the pressure response of the hearing aid as a function of frequency in a plurality of cavities. For example, the plurality of cavities includes at least two cavities, such as two, four, or six cavities. The plurality of pressure responses $p_i$ (f, V) is then used to determine the source impedance $Z_s$(f) and the open circuit pressure $p_s$ (f, V). f is the frequency, V is the voltage applied to the earphone, and i indicates the cavity number between 1 and N. N represents the total number of cavities. As another example, the Norton admittance $Y_s$ (f) is determined to be equal to $1/Z_s$(f), and the short-circuit volume velocity $U_s$ (f, V) is also determined to be equal to $p_s$(f, V)/$Z_s$(f).

According to another embodiment, a system for providing hearing assistance with automatic adjustment includes a processing system, a control system coupled to the processing system, an earphone coupled to the control system, and a first microphone and a second microphone coupled to the control system. The earphone is configured to provided a plurality of impedance values. The earphone and the first microphone are configured to be placed inside an ear canal. The system for providing hearing assistance can perform the method 200, 300, 400, 460, and/or 500 automatically.

As discussed above and further emphasized here, FIGS. 1-8 including 4(*a*) and (*b*) are merely examples, which should not unduly limit the scope of the claims herein. One of ordinary skill in the art would recognize many variations, alternatives, and modifications. In one embodiment, the component $R_0$ and the slope $R_1$ of reflectance are replaced by other types of reflectance components or slopes respectively. For example, the reflectance component and slope include a component and a slope of the reflected pressure $P^-$. In another example, the reflectance component and slope include a component and a slope of $Z_{ec}$. In one embodiment, the component and slope of $Z_{ec}$ can be determined by R and $Z_0$ according to Equation 8. In another embodiment, the component and slope of $Z_{ec}$ can be determined by a Taylor series expansion of $Z_{ec}$ with respect to $P^+$ as shown below.

$$Z_{ec}(f,P^+) \cong Z_{ec,0}(f)+Z_{ec,1}(f)\times P^+ + Z_{ec,2}(f)\times (P^+)^2 \quad \text{(Equation 11)}$$

where $Z_{ec,0}$ is a constant component, and $Z_{ec,1}$ is a slope of $Z_{ec}$. In yet another example, the reflectance component and slope include the component $R_0$ and the slope $R_1$ of reflectance.

The present invention has various applications. Certain embodiments of the present invention provide a hearing aid and a method for automatically adjusting the hearing aid. The hearing aid is placed in the ear canal, and with the push of a button the hearing aid can "tune itself" automatically without intervention from an audiologist. Once tuned, the software in the hearing aid can automatically monitor the performance by constantly measuring the power absorbed in-situ. If the ear conditions have changed significantly, the owner of the hearing aid is notified to contact the hearing professional for a reevaluation of the data and of the observed changes.

The present invention has various advantages. Some embodiments of the present invention can significantly lower the cost of hearing aid fitting and improve the quality of average patient fitting. For example, the variance in hearing aid fitting can be greatly reduced. Certain embodiments of the present invention can greatly reduce or remove the intervention of the hearing aid professional in some technically difficult and high-risk tasks for prescribing a hearing aid for a patient. This would allow the professional to focus on the patient rather than on aid-specific technical details. Some embodiments of the present invention provide a hearing aid that can automatically and in situ adjust compression parameters and frequency-dependent gain of the hearing aid. For example, the hearing aid performs the adjustment based on measurements the hearing aid makes in the ear, either automatically, in a scheduled manner, or when the hearing aid is manually instructed to do so. The manual instruction may be generated via some virtual button such as an electronic command. Certain embodiments of the present invention allow for the adjustment of the source impedance of the hearing aid as a function of acoustic pressure and frequency. For example, the source impedance is related to the acoustic impedance of the earphone of the hearing aid.

Some embodiments of the present invention improve the delivery of acoustic power or intensity to the ear canal and/or cochlea. Certain embodiments of the present invention can improve the hearing aid efficiency. Some embodiments of the present invention reduce the effect of standing waves by controlling the acoustic reflectance via a slowly-varying tonic change in driving-point impedance of the output transducer. For example, the output transducer is part of an earphone of the hearing aid. Certain embodiments of the present invention reduce and control sing margins, also known as "feedback margins," defined as the amount of gain that may be provided before the hearing aid becomes unstable and starts to oscillate, or "whistle." For example, the sing margins depend on the acoustic reflectance, which in turn depends on the relative impedance between the earphone and the ear canal.

Some embodiments of the present invention provide significant improvements to clinical evaluation tools for hearing aid and also reduce the variability in the measurements. Certain embodiments of the present invention provide a hearing aid capable of measuring acoustic reflectance as a function of acoustic pressure and frequency. Some embodiments of the present invention use contra-lateral sound as the stimulus and the acoustic reflectance as the output control measure. For example, the reflectance change indicates the cochlear response to the contra-lateral stimulus, and serves as a measure for the status of inner hair cells and outer hair cells. Certain embodiments of the present invention provide a hearing aid that can automatically determine acoustic parameters of the hearing aid. For example, the acoustic parameters include ones of the earphone. As another example, the automatic determination is performed for the purpose of in-situ characterization of the middle and inner ear via the ear canal.

Some embodiments of the present invention can automatically adjust a hearing aid to the ear canal dynamically and without intervention on the part of the user. Certain embodiments of the present invention use the length and area of the ear canal for adjusting the hearing aid. For example, the length and area are determined during the making of the ear mold. As another example, the area of the ear canal is estimated based on the size of the ear tip used by the tester, which can be determined semi-automatically. Some embodiments of the present invention monitor changes of the ear and/or the hearing aid. For example, such changes reveal ear wax buildup, and/or colds and other minor inflammation of the middle ear. As another example, the monitoring is performed to detect middle ear infections in children with a history of middle ear problems. In yet another example, the monitoring is performed by a handheld device. In yet another example, the warnings and information can be delivered to the ear via a voice message delivered from the hearing aid.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A method for adjusting a hearing aid, the method comprising:

delivering an electrical signal to the earphone to generate an acoustic signal as a function of frequency with the hearing aid receiver within an ear canal;

measuring a total pressure within the ear canal terminated by an ear drum, wherein the total pressure is a sum of the incident pressure and reflected pressure;

determining the reflected pressure based on the total pressure;

calculating, with a processor, the acoustic impedance based on a ratio of reflected pressure to incident pressure, the acoustic reflectance varying with respect to the incident pressure, frequency, and intensity;

adjusting the acoustic impedance of the receiver based on at least the calculated acoustic impedance of the ear canal to increase power to the ear canal and simultaneously reduce acoustical feedback by decreasing power out a vent path of the hearing aid.

2. The method of claim 1, further comprising:

calibrating the receiver to determine the source parameters of the receiver;

determining the reflected pressure based on the source parameters.

3. The method of claim 2 wherein the source parameters are selected from Thévenin source parameters and Norton source parameters.

4. The method of claim 1, further comprising computing, with the processor, an acoustic reflectance based on the ratio of reflected pressure to incident pressure, the computed acoustic reflectance varying with respect to the incident pressure and the frequency.

5. The method of claim 4, further comprising: calculating, with the processor, the acoustic impedance of the ear canal based on the acoustic reflectance of the ear canal.

6. The method of claim 1, further adjusting the acoustic impedance of the receiver to match the acoustic impedance of the ear canal.

7. The method of claim 1 further comprising adjusting the electrical impedance of the receiver to adjust the acoustic impedance of the receiver.

8. The method of claim 2, further comprising:

determining the reverse transfer function for the receiver based on calibrating the receiver;

calculating the electrical impedance of the receiver based on the reverse transfer function;

adjusting the acoustic impedance of the receiver based on the calculated electrical impedance.

9. The method of claim 1, wherein the generating of the acoustic signal within the ear canal is done by applying a voltage to an earphone.

10. A hearing device, comprising:

a receiver and an earphone located within an ear canal;

at least one processor configured to:

deliver an electrical signal to the earphone to generate an acoustic signal as a function of frequency with the receiver within the ear canal;

measure a total pressure within the ear canal terminated by an ear drum, wherein the total pressure is a sum of the incident pressure and reflected pressure;

determine the reflected pressure based on the total pressure;

calculate, with a processor, the acoustic impedance based on a ratio of reflected pressure to incident pressure, the acoustic reflectance varying with respect to the incident pressure, frequency, and intensity;

adjust the acoustic impedance of the receiver based on at least the calculated acoustic impedance of the ear canal to increase power to the ear canal and simultaneously reduce acoustical feedback by decreasing power out a vent path of the hearing aid.

11. The hearing device of claim 10, wherein the at least one processor further configured to:

calibrate the receiver to determine the source parameters of the receiver;

determine the reflected pressure based on the source parameters.

12. The hearing device of claim 11 wherein the source parameters are selected from Thévenin source parameters and Norton source parameters.

13. The hearing device of claim 10, wherein the at least one processor further configured to:

compute, an acoustic reflectance based on the ratio of reflected pressure to incident pressure, the computed acoustic reflectance varying with respect to the incident pressure and the frequency.

14. The hearing device of claim 10, wherein the at least one processor further configured to:

calculate the acoustic impedance of the ear canal based on the acoustic reflectance of the ear canal.

15. The apparatus of claim 10, wherein the processor is further configured to adjust the acoustic impedance of the receiver to match the acoustic impedance of the ear canal.

16. The apparatus of claim 10, wherein the electrical impedance of the receiver is adjusted to adjust the acoustic impedance of the receiver.

17. The apparatus of claim 10, wherein the processor is further configured to:

determine the reverse transfer function for the receiver based on calibrating the receiver;

calculate the electrical impedance of the receiver based on the reverse transfer function;

adjust the acoustic impedance of the receiver based on the calculated electrical impedance.

18. The apparatus of claim 10, wherein the generating of the acoustic signal within the ear canal is done by applying a voltage to the earphone.

* * * * *